US005765344A

United States Patent [19]

Mandeville et al.

[11] Patent Number: 5,765,344

[45] Date of Patent: Jun. 16, 1998

[54] STRETCH WRAPPING FILM CUT-OFF SYSTEM

[75] Inventors: Stephen Marcel Mandeville, Sherbrooke; Glen Joseph Ditchburn, Ayer's Cliff; Christian S. Vezina, Sherbrooke, all of Canada

[73] Assignee: Wulftec International Inc., Ayer's Cliff, Canada

[21] Appl. No.: 805,944

[22] Filed: Feb. 21, 1997

[51] Int. Cl.[6] ..... B65B 53/00

[52] U.S. Cl. ..... 53/441; 53/556; 53/389.3

[58] Field of Search ..... 83/175, 660; 225/4, 225/100; 53/556, 441, 389.3

[56] References Cited

U.S. PATENT DOCUMENTS

| | | | |
|---|---|---|---|
| 4,765,120 | 8/1988 | Phillips | 53/441 |
| 4,917,008 | 4/1990 | Van Den Wildenberg | 53/556 X |
| 5,014,489 | 5/1991 | Terminella et al. | 53/556 X |
| 5,372,494 | 12/1994 | Vaughan | 83/660 X |
| 5,572,850 | 11/1996 | Lancaster et al. | 53/441 X |

*Primary Examiner*—Linda Johnson
*Attorney, Agent, or Firm*—C. A. Rowley

[57] ABSTRACT

In a stretch wrapping system, the film is punctured about half way across its width to form a small hole which is expanded in the prestretch station and the film finally broken by abruptly increasing film tension at the end of a wrapping operation.

4 Claims, 6 Drawing Sheets

STRETCH WRAPPING FILM CUT-OFF SYSTEM

FIELD OF INVENTION

The present invention relates to a stretch wrap film cut-off mechanism, more particularly, the present invention relates to a film puncturing and tearing for completing a stretch wrapping operation.

BACKGROUND OF THE INVENTION

Pallet wrapping or the like generally involves relatively rotating a source of film and the object or pallet to be wrapped so that the film is wound round the pallet or article. In some equipment the pallet is rotated, generally around a vertical axis and in others the pallet being wrapped is stationary and the film source is moved there around to wind the film about and thereby wrap the pallet. At the completion of the wrapping operation, it is necessary to sever the film to disconnect the film from the pallet so that the pallet may be moved and a free end of the film is available for wrapping another pallet or the like. It is common practice for many of these wrapping systems to prestretch the film prior to wrapping it about the pallet. The prestretching of the film increases the strength of the film per unit area and increases its length so that less film is necessary to complete the wrapping operation.

A variety of different systems are available for cutting or breaking the film when the wrapping operation has been completed. The film may be cut manually i.e. an operator may use a suitable knife to sever the film at the appropriate location or automatically by providing a shear or the like having a cutting or perforating blade that extends across the full width of the film generally as the last operation on the film before it is applied to the pallet. Preferably severing has been performed adjacent to the pallet. In a prestretch wrapping system wherein the film is withdrawn from a source (normally a roll of film) and then prestretched between a pair of rolls operating at different peripheral speeds the film is severed in operations after prestretching and immediately before the film is led to the pallet being wrapped.

In most cases, the film is cut or weakened for example by perforating across its full width so that the line of cut or break is defined across the full width of the film. U.S. Pat. No. 5,572,850 issued Nov. 12, 1996 to Lancaster et al., discloses a system wherein the film is punctured after prestretching while the film is under variable tension that is applied between the prestretch stretcher and the pallet or article being wrapped. This system mentions the use of a single piercing point adjacent to the longitudinal center line of the film but describes in more detail piercing or puncturing the film adjacent to each lateral edge of the film to initiate two tears each of which propagates across the film between the two puncture as well as outward to the free edges of the film to complete the severance. Piercing adjacent to the center line while applying variable tension to the prestretched web or film make control of the propagation of the tear difficult. Similarly the use of two propagating tears requires they propagate and meet adjacent to the center line of the film which invariably must happen, however each tear may also propagate axially of the film (parallel to the axial center line) to produce a more ragged tear where the two tears meet, and loss of control over the location of the tear or line of severance may occur. Depending on the location pierced hole(s) premature propagation of the tear to one of the outside edges of the film will cause loss of control of tear location.

Similarly puncturing the prestretched film i.e. after prestretching as taught in the patent requires that substantially all of the tearing forces are applied between the prestretch and the article or pallet being wrapped and thus the tear(s) is propagated by varying tension forces that are necessarily applied as the pallet and the source of film are relatively rotated which may have an adverse effect on controlling the break in the film.

BRIEF DESCRIPTION OF THE PRESENT INVENTION

It is an object of the present invention to provide an improved cut-off system for a stretch wrap machine.

Broadly, the present invention relates to a stretch wrapping system comprising a mounting carriage, a source of wrapping film on said mounting carriage, a prestretch station mounted on said carriage in a position to receive film from said source, said prestretch station including means for stretching said film in a direction parallel to a longitudinal axis of said film to form a prestretched film, means for directing said prestretched film under axial tension from an output side of said prestretch station to an article being wrapped, means to relatively rotate said article and said mounting carriage, a hole punch system, the improvement comprising mounting said hole punch system in a position to puncture said film between said source and said prestretch station, said hole punch system being positioned to puncture a hole in said film at a hole location spaced from opposite lateral side edges of said film by a distance of at least ⅓ the width of said film between said opposite lateral side edges of said film and control means for activating said punch system to punch said film during a relative rotation between said article and said carriage to wrap said article, said control means causing an increase tension in said film between said prestretch station and said article being wrapped after said puncture has traveled through and been significantly expanded under control in said prestretch station and wrapping of said article is substantially complete, said tension being increased by an amount sufficient to complete tearing of said film completely thereacross between each opposite side of said puncture and its adjacent side edges of said prestretched film.

The present invention also relates to a method of wrapping an article comprising withdrawing a wrapping film from a source of said film, axially prestretching said film in a prestretch station to form a prestretched film, and then wrapping said prestretched film about said article to wrap said article, completing wrapping by puncturing said film to form a puncture in said film at a hole location spaced from opposite lateral side edges of said film by a distance of at least ⅓ the width of said film between said opposite lateral side edges of said film before said axial prestretching, expand said puncture toward said lateral side edges by axially stretching said film in said prestretch station, and abruptly increasing the tension in said film between said prestretch station and said article when said puncture approaches said article being wrapped to apply sufficient tension to said film to tear said film completely thereacross between said puncture and said lateral side edges.

Preferably, said location is substantially midway between said lateral side edges

BRIEF DESCRIPTION OF THE DRAWING

Further features, objects and advantages will be evident from the following detailed description of the preferred embodiments of the present invention taken in conjunction with the accompanying drawings in which.

DESCRIPTION OF THE PREFERRED EMBODIMENTS

Figure 1:
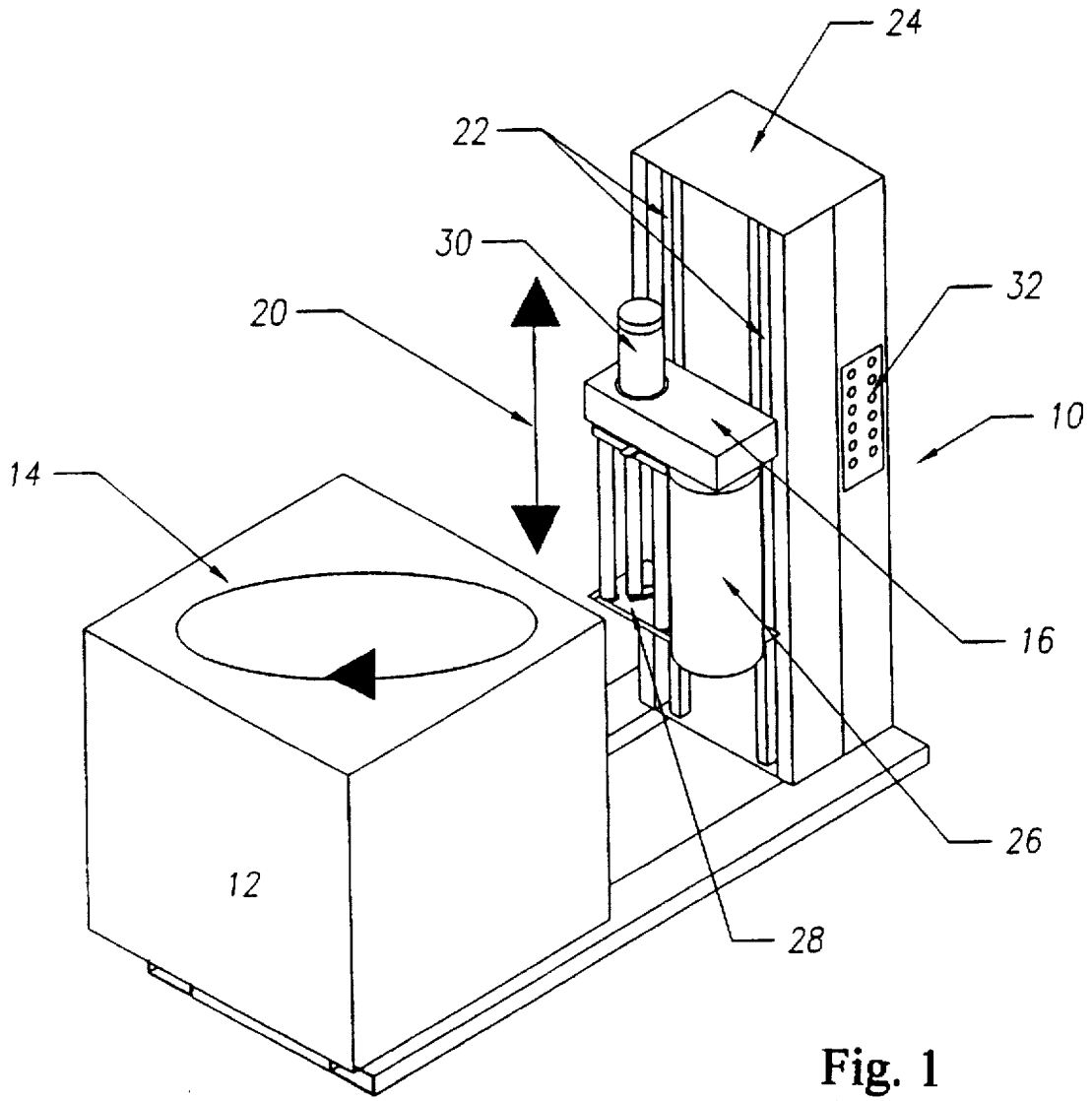
FIG. 1 is a isometric view of one type of typical stretch wrapping system in which the present invention may be employed.
Figure 2:
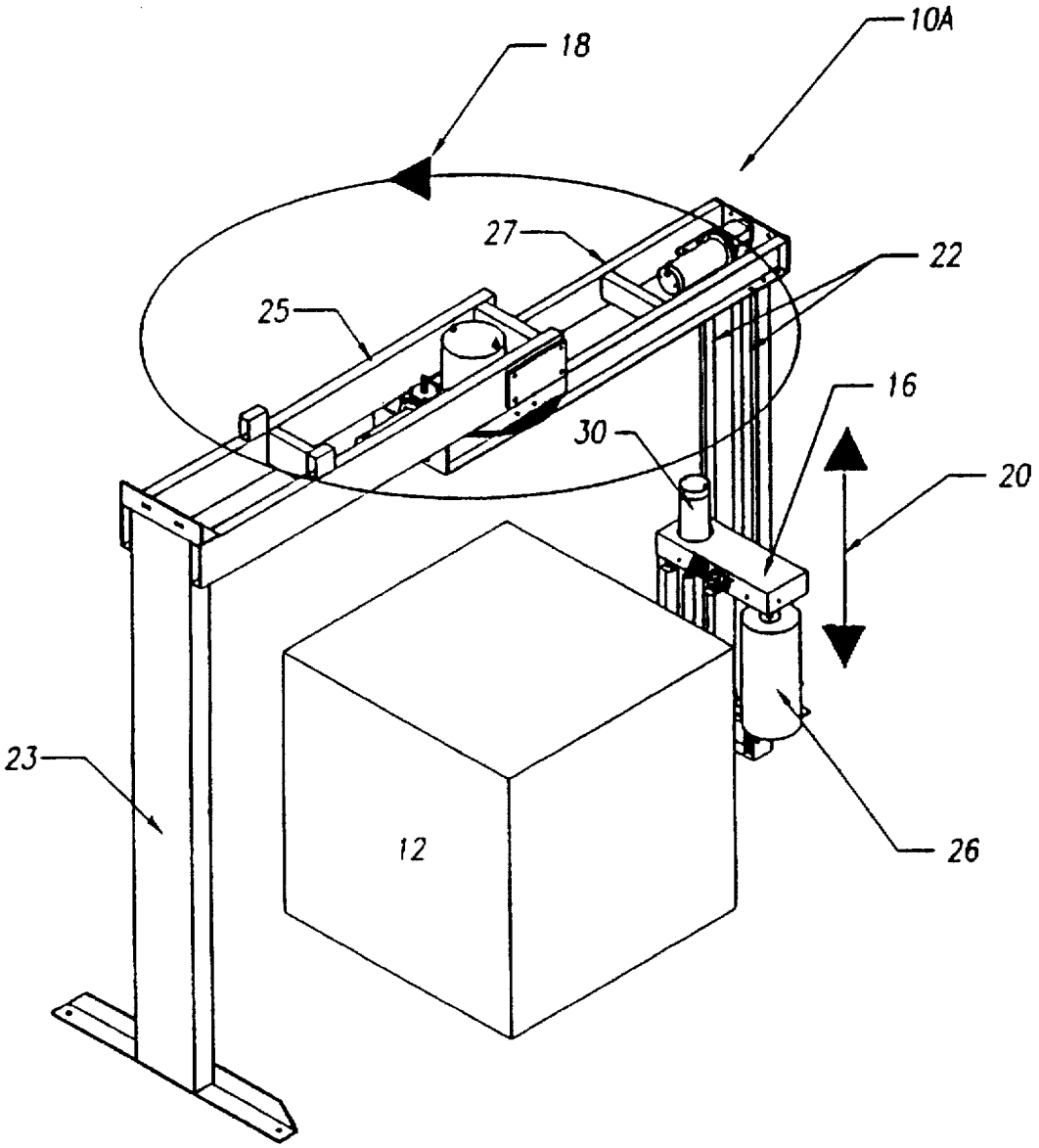
FIG. 2 is a isometric view of another type of typical stretch wrapping system in which the present invention may be employed.

As shown in FIG. 1, the pallet wrapper 10 of the present invention is similar to other film prestretch article or pallet wrappers in that the pallet 12 is rotated as indicated by the arrow 14 (or the mounting carriage 16 is rotated around the pallet 12 as illustrated by the arrow 18 in the second type of stretch wrapper shown in FIG. 2) to relatively rotate the film source 26 and the article being wrapped to wind the film 50 (see FIG. 3) around the article or pallet 12. At the same time as the pallet 12 and mounting carriage 16 are being relatively rotated, the carriage 16 is moved vertically as indicated by the arrow 20 on the tracks 22 on the pillar 24 so that the film 50 is wrapped in a helix around the pallet 12 and preferably covers substantially the fill height of the pallet 12. In the arrangement illustrated in FIG. 1, the pallet 12 is rotated as indicated by the arrow 14 and the pillar 24 mounting the carriage 16 and the source 26 is fixed.

The carriage 16, as will be described in more detail hereinbelow, carries a roll of film 26 (film source) from which a ribbon of film 50 is drawn and is passed through a prestretch station generally indicated at 28. The rollers of the prestretch station 28 are driven by a suitable motor 30.

The stretch wrapper type shown in FIG. 2 rotate the carriage 16 as indicated by the arrow 18 about the pallet 12. In this arrangement an arm 27 is rotatably mounted on a substantially horizontal arm 25 extending from a support pillar 23. The carriage 16 is mounted on a supported column 24A that projects downward from the arm 27 in the same manner as it was mounted on the pillar 24 of the FIG. 1 stretch wrapper.

A control 32 (see FIGS. 1, 2 and 3) which may be any suitable type of control such as a PLC programmer, controls device 33 that controls the drive that relatively rotates the pallet 12 and carriage 16, i.e. in the FIG. 1 case, the rate of rotation of the pallet 12 as indicated by the arrow 14 or in the FIG. 2 case the rotation of the carriage 16 as indicated by the arrow 18; the up and down movement of the carriage 16 on the pillar or column 24 as indicated by the arrow 20; and the amount of prestretch applied to the film 50 in the station 28 as indicated at 35 as well as the timing of the various stages of the wrapping operation, e.g. so that when the wrapping of the pallet 12 is being completed the film is punctured at the appropriate time and a brake or the like (not shown) is applied to abruptly vary the tension in the punctured film 50P to complete the breaking of the film by tearing thereacross as will be described below.

Figure 3:
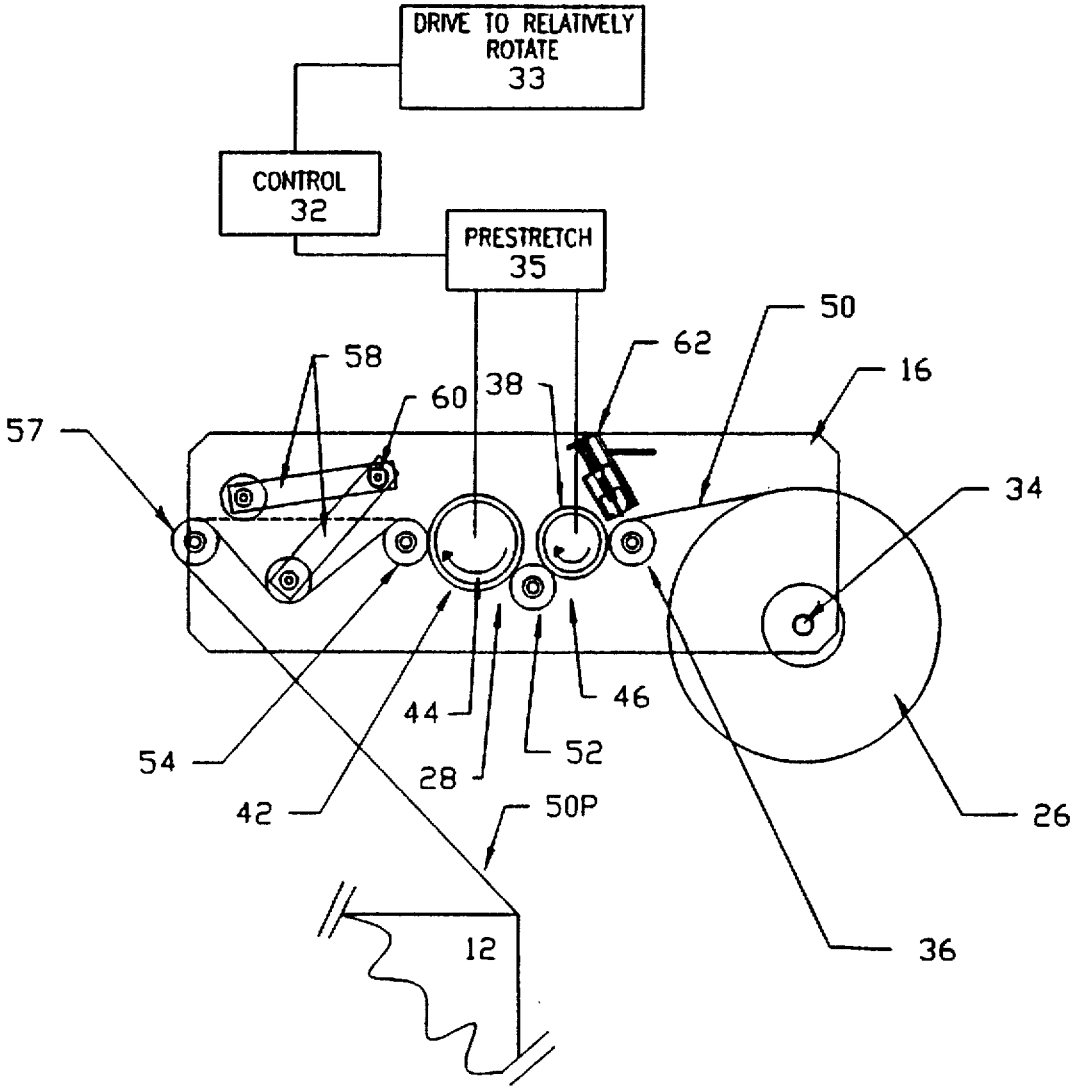
FIG. 3 is a plan view of a typical prestretch mechanism and off-feed of film from a supply roll illustrating the location of the puncturing means of the invention.

FIG. 3 shows a plan view of the mounting carriage 16 and the components carried thereon. As illustrated, the carriage 16 carries the roll of film 26 that is unwound, generally under tension, by rotation about an axis of a shaft 34. The film 50 is unwound from the roll 26 and passes over a feed roller 36 that guides the film web or ribbon 50 into the prestretch station 28 which includes a first prestretch roll 38 and a second or outgoing prestretch roller 42. The roller 38 is controllably rotated as indicated by the arrow 40 at a first speed to draw the film 50 from the roll 26 and the second or outgoing prestretch roller 42 is rotated as indicated by the arrow 44 in the same direction as the roll 38 but at a higher speed. The rolls 38 and 42 have an outer wrapper 46 and 48 respectively that is a high friction material to grip the film 50 so that there is little slippage between the peripheries of the rollers 38 and 42 and the film 50. The peripheral speed of the roll 38 is maintained slower than that of the roll 42 so that the prestretched web 50P leaving the roll 42 is moving faster than the web 50 leaving the roll 38 so that the web 50 is prestretched between the two rolls 38 and 42 with the degree of prestretch being determined by the difference in peripheral speeds between the rolls 38 and 42.

Preferably, a neck down roller 52 is positioned between the prestretch rollers 38 and 42 to minimize neck down (lateral contraction of the film 50) in the conventional manner.

On leaving the prestretch station 28, the prestretched film 50P passes over the first outfeed roller 54 and is controlled by a dancer bar 56 (shown in two positions in FIG. 2) mounted on a bar 58 that pivots on shaft 60. This movement of the dancer bar 56 accommodates the different pulling rates of feed applied by the pallet 12 to the film 50P which vary depending on the location on pallet from which the film 50 is being pulled as the pallet and source 26 are being relatively rotated.

The present invention incorporates a suitable punch or punch system generally indicated at 62 located on the path of the film 50 before or at the prestretch station 28. The operation of the punch 62 is controlled by controller 32 to at the appropriate time punch the film 50 to form a perforation in the film 50 as the film 50 travels between the roll 26 and the prestretch station 28.

Any suitable punch system 62 may be used for example a controlled arc (depending on the thickness and material of the film) or a needle punch or the like to form a hole in the film at the appropriate time and location.

Figure 4:
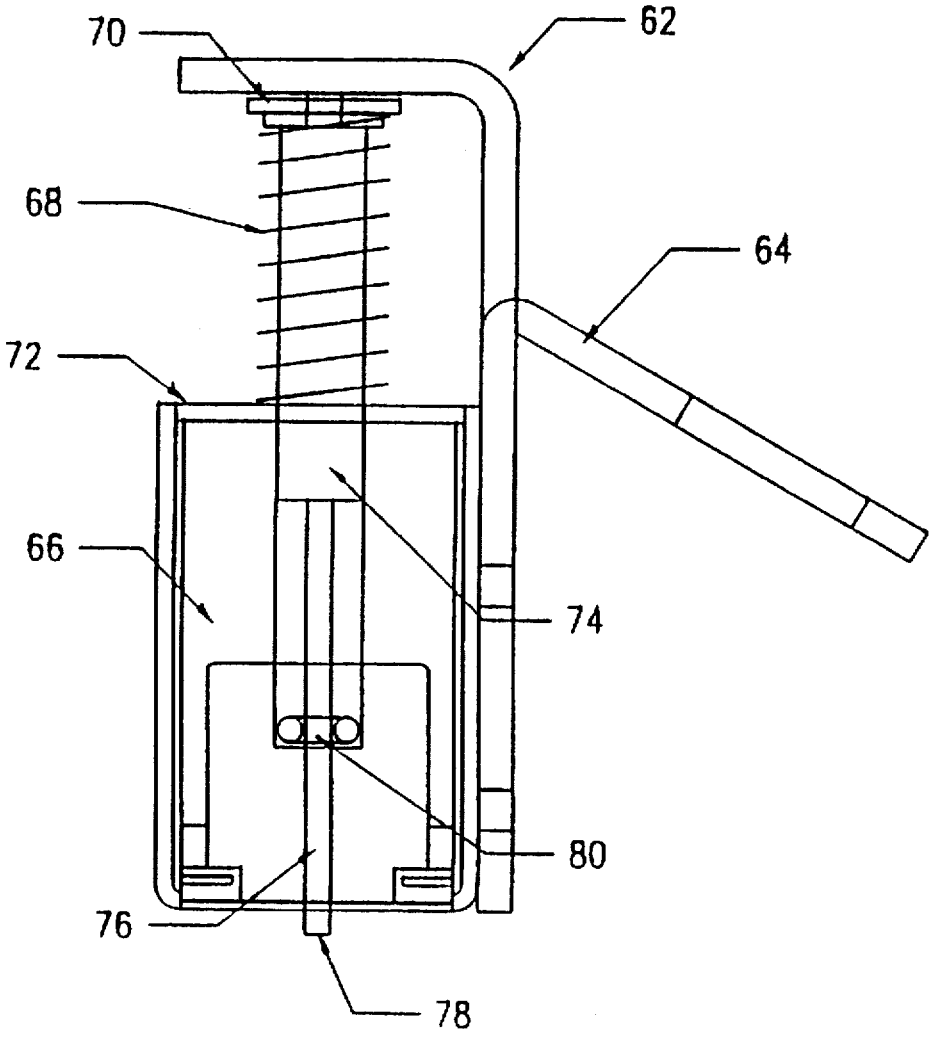
FIG. 4 is a schematic illustration of a suitable puncturing mechanism for use with the present invention.

FIG. 4 illustrates a punch system 62 that has been found satisfactory. This system 62 is mounted on the carriage 16 in the position as above described via a mounting bracket 64. The puncturing device or punch 62 includes a solenoid 66 that is held in retracted position via a spring 68 wrapped therearound and extending between a flange or spring retainer 70 on the solenoid armature or shaft 74 and a fixed top 72 of the solenoid 66. A punching element 76 projects axially from the opposite end or the shaft 74 to where the retainer is positioned. The punching element has a punching end 78 at its end remote from the retainer 70. Preferably, an O-ring 80 acts a shock absorber for the solenoid 74 at the end of its axial movement in the punching direction.

Figure 5:
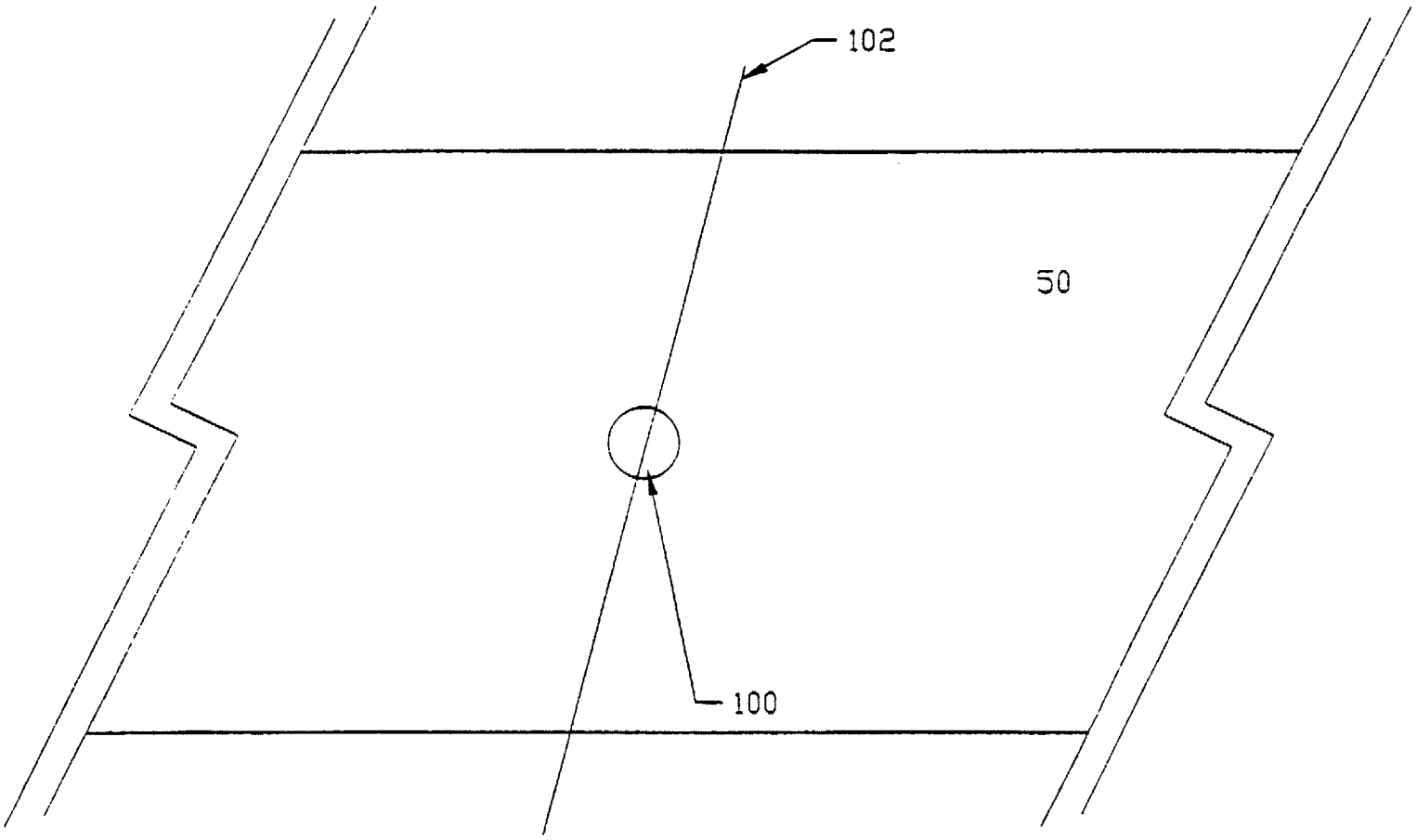
FIG. 5 shows the punctured film immediately after puncturing of the film and prior to the prestretch station.

Preferably only a single hole 100 (see FIG. 5 and 6) is punched through the film, however if desired more than one hole 100 may be punched, however when more than one hole 100 is punched the holes 100 will preferably be symmetrically positioned relative to the longitudinal axis of the film 50 and on a line substantially perpendicular to that axis. The hole(s) 100 preferably will be space from an adjacent lateral edge of the film by a distance of at least ⅓ the total width of the film 50 and will normally have a diameter in the range of about 3/32 to 3/16 inches.

The location of the punch or perforator 62, if required, may be made adjustable transversely of the film path to accommodate different width of films 50.

In operation, the film 50 is fed from the roll 26 via the roll 38 and is stretched in the prestretch station 28 by an amount determined in known manner by the difference in peripheral speeds the rolls 42 and 38 to form the prestretched film 50P which then passes over the out feed roller 54, dancer bar 56 and turning roller 57 and is delivered to the pallet 12 and wrapped there around as above described. When wrapping is substantially completed, i.e. on the last rotation, the control 32 activates the punching device or system 62 to punch a hole 100 in the film 50 (see FIG. 5) spaced, as above described, from a side edge of the film 50 by distance of at least ⅓ the distance between the two lateral side edges of the film (i.e. ⅓ of the film width). Preferably the hole 100 will be punched or made substantially along or adjacent to the axial center line 102 of the film 50. This hole 100 as above described will normally have a diameter in the range of about 3/32 to 3/16 inches. However, the actual size of the hole 100 is not critical except that it must not be so large as to cause the film 50 to split i.e. tear completely across the full width of the film, in the prestretch station 28.

Figure 6:
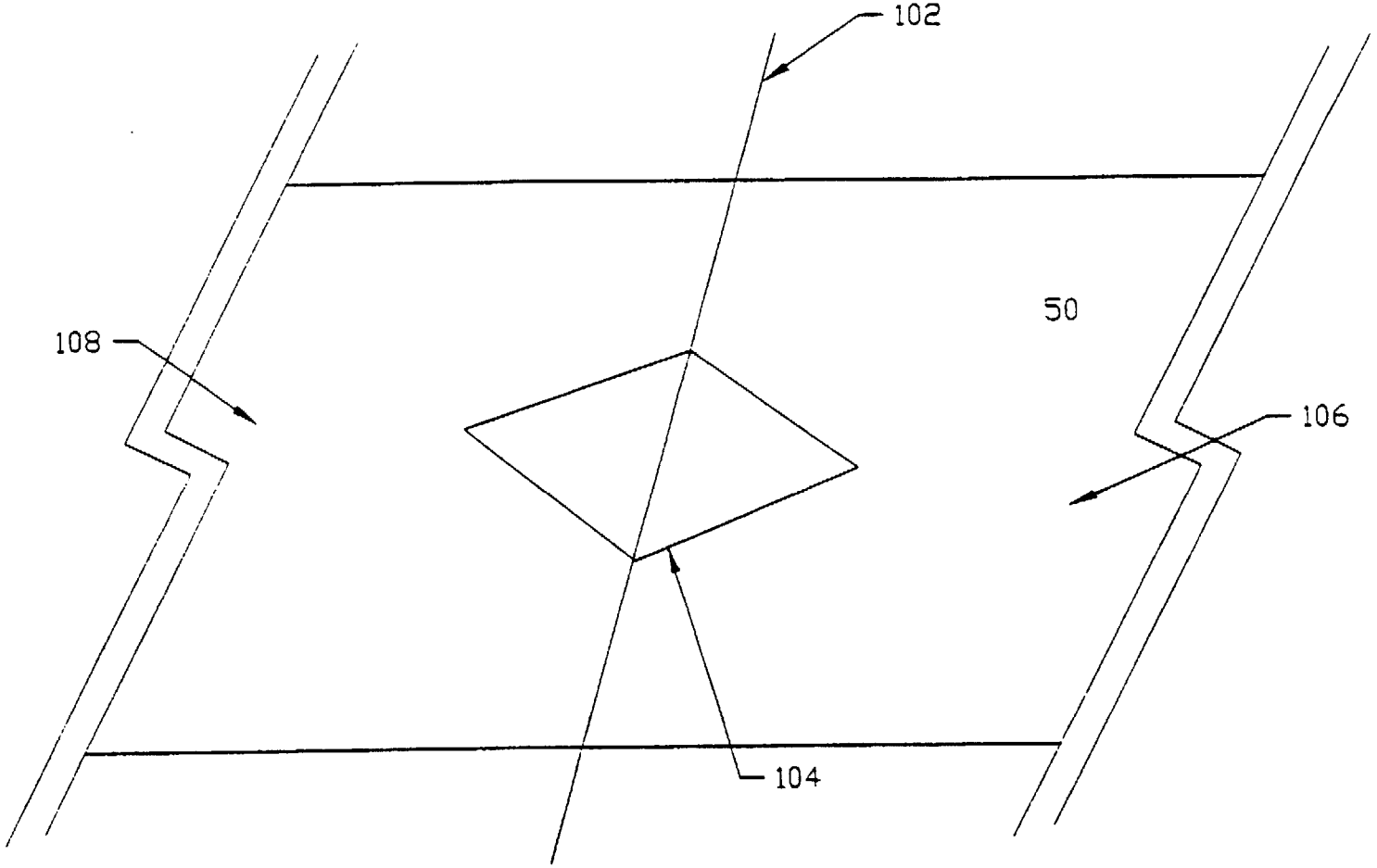
FIG. 6 shows a partly expanded puncture part way through the prestretch operation.

As the film 50 with the hole 100 punched therein passes through the prestretch station or zone 28, the hole 100 is expanded as indicated at 104 in FIG. 6 under control of the prestretch station 28 to controllably significantly enlarge the hole 100 so that the prestretched film SOP on leaving the prestretch station 28 has only outer bridges one on each side of the expanded hole 104 and adjacent to the lateral side edges of the film 50P as indicated at 106 and 108 that have not been torn thereacross and these areas or bridges form ropes like elements to carry the film from the outfeed roll 57 to the pallet 12 without breaking e.g. tearing across so that control of the break is not lost.

As the hole 104 approaches the pallet 12, the tension in the film 50P is preferably abruptly increased under control of the control 32 and control device 33 to the point where the ropes 106 and 108 break to complete the tearing across the film 50 and provide a controlled line of breakage, the position of which is relatively accurately predictable.

The system has been found effective over a range of prestretch of between 75 and 275% and to be effective for film thickness of up to about 1 mil.

Having described the invention, modifications will be evident to those skilled in the art without departing from the scope of the invention as defined in the appended claims.

We claim:

1. A stretch wrapping system comprising a mounting carriage, a source of wrapping film on said mounting carriage, a prestretch station mounted on said carriage in a position to receive film from said source, said prestretch station including means for stretching said film in a direction parallel to a longitudinal axis of said film to form a prestretched film, means for directing said prestretched film under axial tension from an output side of said prestretch station to an article being wrapped, means to relatively rotate said article and said mounting carriage, a hole punch system, the improvement comprising mounting said hole punch system in a position to puncture said film between said source and said prestretch station, said hole punch system being positioned to puncture a hole in said film at a hole location spaced substantially midway between opposite lateral side edges of said film and control means for activating said punch system to punch said film during a relative rotation between said article and said carriage to wrap said article, said control means controlling rate of said relative rotation to causing increase tension in said film between said prestretch station and said article being wrapped after said puncture has traveled through and been significantly expanded under control in said prestretch station and wrapping of said article is substantially complete, said tension being increased by an amount sufficient to complete tearing of said film completely thereacross between each opposite side of said puncture and its adjacent side edges of said prestretched film.

2. A stretch wrapping system as defined in claim wherein said hole when punched is between 3/32 and 3/16 inches in diameter.

3. A method of wrapping an article comprising withdrawing a wrapping film from a source of said film, axially prestretching said film in a prestretch station to form a prestretched film, and then wrapping said prestretched film about said article to wrap said article, completing wrapping by puncturing said film to form a puncture in said film, the improvement comprising, said puncturing punctures a hole in said film at a hole location substantially equally spaced from opposite lateral side edges of said film and punctures said hole in said film before said axial prestretching of said film so that said axially prestretching controllably expands said hole toward said lateral side edges by axially stretching said film during said axially prestretching, and abruptly increasing the tension in said film between said prestretch station and said article when said hole approaches said article being wrapped to apply sufficient tension to said film to tear said film completely thereacross between said puncture and each of said lateral side edges thereby to control the location at which said film tears.

4. A method as defined in claim 3 wherein said hole when punched is between 3/32 and 3/16 inches in diameter.

* * * * *